United States Patent [19]

Renée

[11] Patent Number: 4,759,398

[45] Date of Patent: Jul. 26, 1988

[54] OPERATOR FOR VENETIAN BLINDS COMBINATION OPERATOR AND VENETIAN BLIND, AND METHOD OF OPERATING VENETIAN BLINDS

[76] Inventor: William C. Renée, 22722 Waterside La., El Toro, Calif. 92630

[21] Appl. No.: 735,797

[22] Filed: May 17, 1985

Related U.S. Application Data

[63] Continuation-in-part of Ser. No. 619,261, Jun. 11, 1984, abandoned.

[51] Int. Cl.[4] ..... E06B 9/38

[52] U.S. Cl. ..... 160/178.1; 160/177; 74/89.15

[58] Field of Search ..... 160/178 R, 177, 176, 160/174, 168 R, 166 R, 166 A; 74/499, 509, 424.8, 89.15; 446/241

[56] References Cited

U.S. PATENT DOCUMENTS

| | | | |
|---|---|---|---|
| 1,271,619 | 7/1918 | Sapper . | |
| 1,855,346 | 4/1932 | Forse . | |
| 2,116,357 | 5/1938 | Laborda et al. | 156/17 |
| 2,301,485 | 11/1942 | Walker | 160/170 |
| 2,401,770 | 6/1946 | Nardulli | 160/168 |
| 3,364,757 | 1/1968 | Sears | 74/89.15 |
| 3,381,460 | 8/1974 | Linley, Jr. | 74/459 |
| 3,425,479 | 2/1969 | Lorentzen et al. | 160/176 |
| 3,656,358 | 4/1972 | Kopp | 74/89.15 |
| 3,921,695 | 11/1975 | Debs | 160/176 |
| 4,011,684 | 3/1977 | Stanzel | 74/89.15 X |
| 4,122,885 | 10/1978 | Marotto | 160/176 |
| 4,210,033 | 7/1980 | Erickson et al. | 74/424.8 |
| 4,249,426 | 2/1981 | Erickson et al. | 74/441 |
| 4,282,764 | 8/1981 | Harris | 74/89.15 |
| 4,335,775 | 6/1982 | Frentzel et al. | 160/177 |
| 4,386,644 | 6/1983 | Debs | 160/174 |
| 4,434,677 | 3/1984 | Linley, Jr. | 74/409 |
| 4,487,243 | 12/1984 | Debs | 160/168 R |

FOREIGN PATENT DOCUMENTS

| | | | |
|---|---|---|---|
| 153833 | 3/1956 | Sweden | 160/178 R |

*Primary Examiner*—Ramon S. Britts
*Assistant Examiner*—David M. Purol
*Attorney, Agent, or Firm*—Richard L. Gausewitz

[57] ABSTRACT

A venetian blind incorporating a wand having an operator thereon at any desired position. The operator is nonrotatably associated with the wand, and the wand and operator are so constructed that longitudinal shifting of the operator rotates the wand about its axis. Resilient frictional drag prongs are incorporated in the operator to prevent undesided movement thereof, as by gravity. A stop and bearing element is mounted on the end of the wand.

14 Claims, 3 Drawing Sheets

FIG. 5.
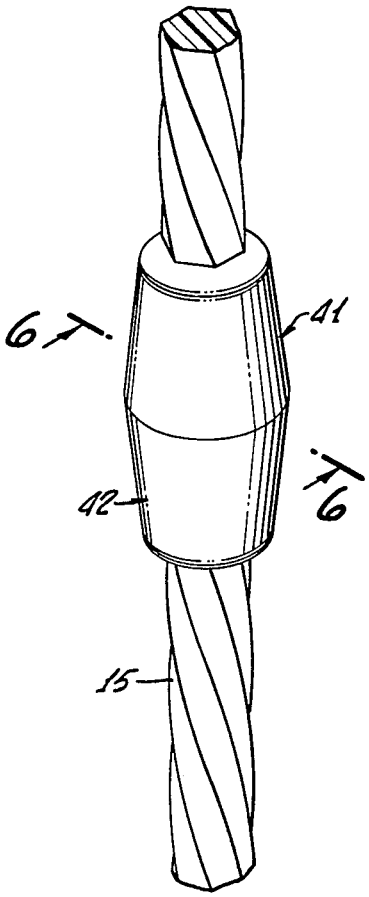
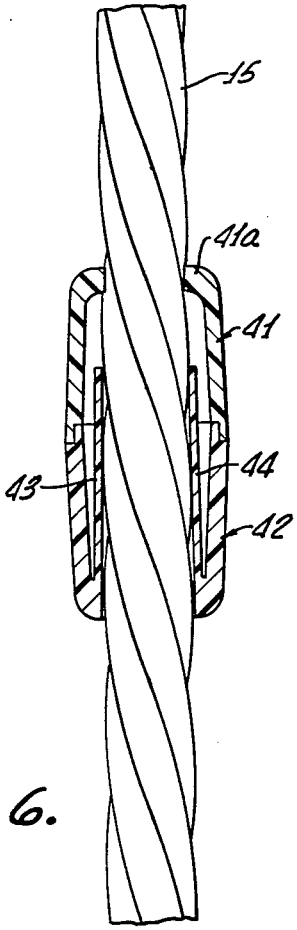
FIG. 6.
FIG. 7.
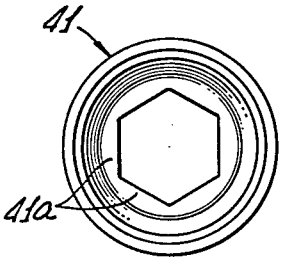
FIG. 8.
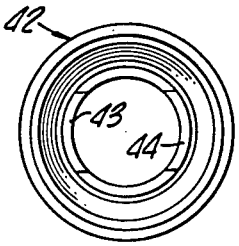

OPERATOR FOR VENETIAN BLINDS COMBINATION OPERATOR AND VENETIAN BLIND, AND METHOD OF OPERATING VENETIAN BLINDS

This application is a continuation-in-part of application Ser. No. 619,261, filed June 11, 1984, now abandoned, for Operator For Venetian Blinds and Combination Operator and Venetian Blind.

BACKGROUND OF THE INVENTION

Large numbers of small-slat venetian blinds, called mini blinds, are today present in the windows of homes, offices, etc. These blinds are operated, to tilt the slats, by manual turning of wands about their longitudinal axes.

There has long been a need for wands to replace those now in service (and which will be used on venetian blinds to be manufactured in the future), and will permit rotation of the wands about their longitudinal axes in a manner vastly easier and faster than is effected by manual turning.

It is important that the wand assemblies not only be simple, economical and capable of preforming the desired function effectively, but also that they may be quickly installed on existing blinds and will operate them even when the tilt mechanisms in the upper portions of the blinds are not well lubricated.

Very importantly, the wands and associated operating mechanisms must be attractive in appearance, rust proof, long-lasting, etc. The wands and associated operating mechanisms must be wear-resistant. They should be positively engaged with each other, that is to say, the operating mechanisms should not be able to rotate relative to the wands unless there is relative axial movement therebetween.

SUMMARY OF THE INVENTION

The wand for a venetian blind has mounted thereon an operator, and means including a helical element are provided to interassociate the wand and operator in such a manner that longitudinal shifting of the operator will rotate the wand about its longitudinal axis, thereby effecting tilting of the slats of the blind. Very importantly, drag means are provided to prevent the operator from moving along the wand in response to gravitational forces. Instead, the operator remains at any position on the wand to which it is manually shifted by the person desiring to tilt the slats.

In a preferred embodiment, the wand has external surfaces that are helical about the axis of the wand. The operator has a driver portion that mates with such helical external surfaces to drive the same when the operator is shifted upwardly or downwardly. Furthermore, drag means are incorporated in the operator to prevent it from dropping downwardly along the wand when released by the person who has tilted the slats.

In the preferred embodiment of the operator mechanism, the drag means and the means for interassociating the wand and operator are incorporated in the same element or elements. These are prongs that are resilent. The tips of the prongs bear against surfaces on and/or grooves in the wand to provide the drag force and, additionally, to prevent rotation of the operator relative to the wand unless there is also axial movement.

A combination stop and bearing means may be provided at the lower end of the wand for grasping by one hand of the user, when desired, especially when the internal mechanism at the upper portion of the blind is not well oiled. In addition, such means prevents the operator from being pulled off the lower end of the wand inadvertently, or by a child.

BRIEF DESCRIPTION OF THE DRAWINGS

FIG. 5 is a side elevational view of a second form of operator, as mounted on a wand, this being the preferred embodiment;

FIG. 6 corresponds to FIG. 5, but shows the operator in longitudinal section;

FIG. 7 is an end view of one of the elements of the operator of FIGS. 5–6, prior to assembly of such operator, the view being taken looking toward the central end of such element;

FIG. 8 is a view corresponding to FIG. 7, but looking toward the central end of the other operator element;

DETAILED DESCRIPTION

Figure 1:
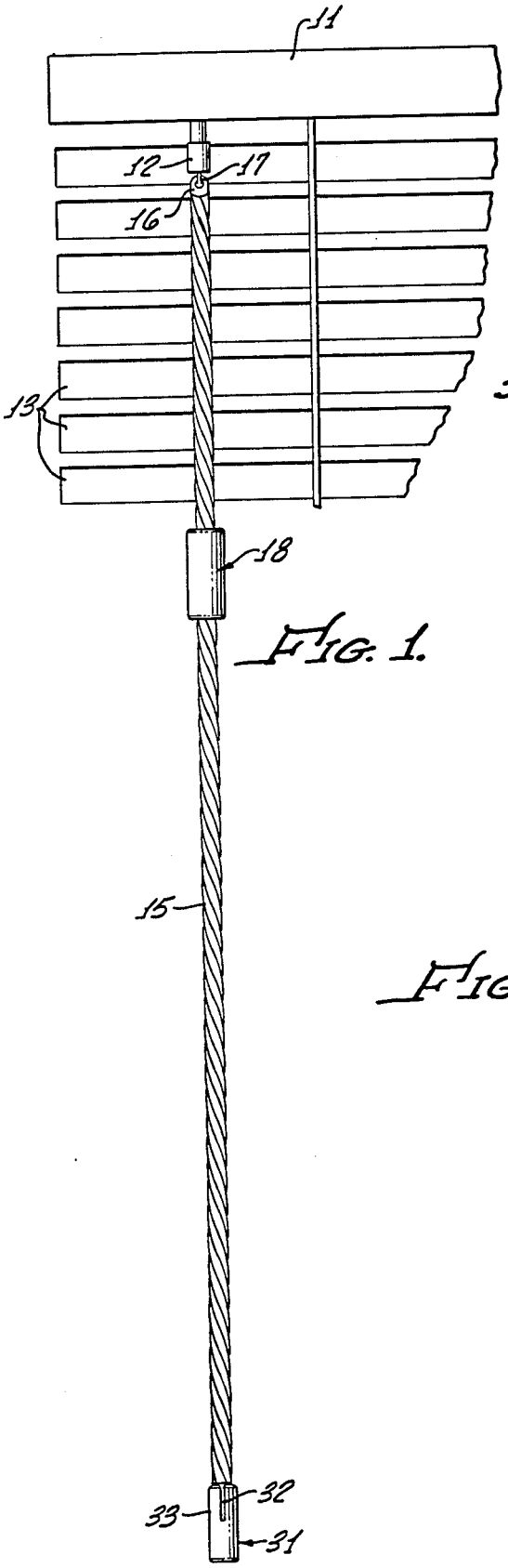
FIG. 1 is a fragmentary, vertical, elevational view of a venetian blind, combined with a wand and operator constructed in accordance with the present invention.

In the present specification and claims, the words "venetian blind" refer to any tilt-slat window shade, etc., that is operated by rotation of a wand about its longitudinal axis. The words include both conventional-size venetian blinds, miniature-size blinds (mini blinds), louver blinds, etc. Furthermore, it is to be understood that the wand may be oriented not only vertically, but horizontally.

The present invention operates well in combination with various venetian blind constructions. Referring to the upper portion of FIG. 1, the illustrated venetian blind 10 has an upper (box) portion 11 mounted on the wall above a window, and having a downwardly-extending operating portion 12 that will tilt the slats 13 of the blind when such operating portion 12 is rotated in either direction about its axis.

To state but one example, the blind 10 may be constructed (except for the wand) as described in detail in U.S. Pat. No. 3,425,479. Said patent is hereby incorporated herein by reference as though set forth in full. Another venetian blind in which the present operator mechanism may be incorporated is described in U.S. Pat. No. 4,122,885, said patent being hereby incorporated herein by reference as though set forth in full.

The present actuating apparatus comprises an elongated wand 15 suspended from the operating portion 12 of the blind. Stated more definetly, the wand 15 has a flattened and apertured upper end 16 that receives a loop or curve 17 of a connector incorporated in operating portion 12. Such portion 17 is (for example) wire, and connects the wand 15 with operating portion 12 so that rotation of the wand about its longitudinal axis will operate the mechanism within the box portion 11 of the blind and thereby tilt the slats 13.

Figure 3:
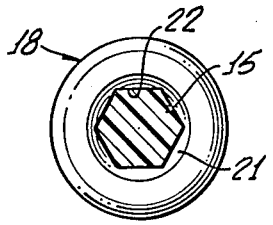
FIG. 3 is a transverse sectional view on line 3—3 of FIG. 2.

Preferably, the wand 15 is an extruded synthetic resin, for example of the butyrate type. The wand is noncircular in section, for example, hexagonal as shown in FIG. 3. During the extrusion process, the wand is caused to assume the illustrated helical shape, so that all six surfaces of the wand are helical. (It is emphasized that other numbers of surface may be employed.) The resulting wand is not only highly functional, but attractive. It may be, for example, transparent.

The wand may have various other cross-sectional shapes. It is nonrotatably associated with an operator 18. Such operator is, preferably, also formed of a synthetic resin, such as Delrin.

Figure 2:
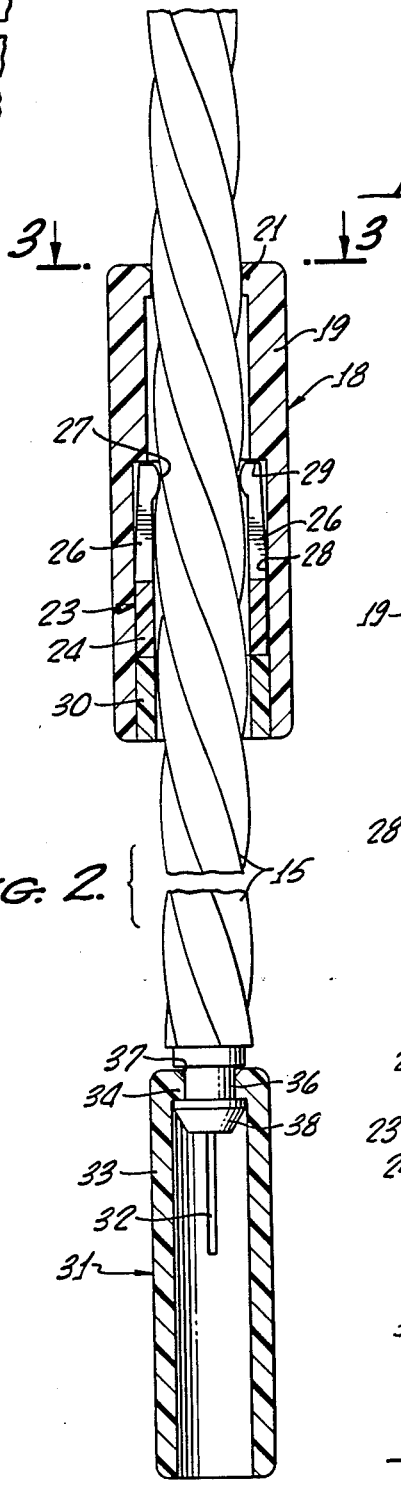
FIG. 2 is a greatly enlarged view, the wand being shown in side elevation, and the operator and bearing means being shown in vertical section.
Figure 4:
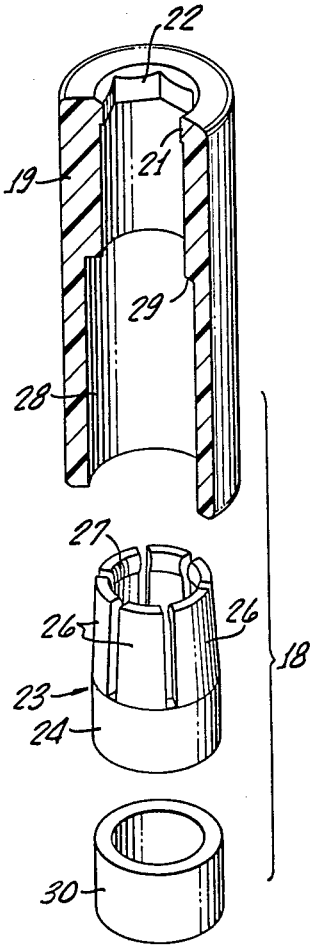
FIG. 4 is an exploded view illustrating the components of the operator shown in FIGS. 1–3.

As best shown in FIGS. 2 and 4, the operator has a body 19 that is preferably elongated and generally tubular. It receives the wand coaxially thereof. Provided in body 19 is a driver portion 21 shaped to mate nonrotatably with a region of the exterior of the surface of the wand 15. In the illustrated form, driver 21 is a necked-down upper end of body 19, the inner surfaces 22 of the necked-down region being hexagonal, as shown in FIGS. 3 and 4, when the wand is hexagonal in section.

The hexagon defined by inner surfaces 22 is only slightly larger than that defined by the surfaces of the wand. Accordingly, the driver portion does not bind or gall on the wand, but it is effective to rotate the wand about its longitudinal axis when the driver is shifted upwardly or downwardly and is itself prevented from rotating substantially.

Very importantly, drag or friction means 23 are incorporated in the operator 18 to prevent the operator from dropping after it is released by a person who has operated the blind. In the embodiment of FIGS. 2–4, the drag or friction means 23 comprises a tubular body 24, preferably formed of synthetic resin, and having spring-prongs 26 integral therewith and extended upwardly therefrom. The prongs 26 have inwardly-extending pad portions 27 at their upper ends, and which frictionally engage the helical surfaces of the wand 15. In the illustrated form, where the wand is hexagonal, there are preferably six prongs 26 and associated pads, so that all six of the helical surfaces are engated. It is emphasized that other numbers of drag elements may be employed, such as (for example) the two shown in the embodiment of FIGS. 5–8, or even one.

The drag or friction means 23 is inserted into an enlarged region 28 in operator body 19, there being a shoulder 29 formed at the upper end of such enlarged region. The drag means 23 is inserted into the enlarged region until the ends of prongs 26 are near, but not in forceable engagement with, the shoulder 29. Then, a mounting ring 30 is inserted into the enlarged region 28 and bonded therein as by a suitable adhesive. Accordingly, the drag or friction means 23 is held in position, but in such a manner that the prongs 26 and pad portions 27 may flex so as to remain in constant resilient contact with the wand surfaces.

It is to be understood that, as molded, the prongs 26 are so inclined that the inner surfaces of pad portions 26 define (generally) surface regions that, as viewed from the end, are smaller than the wand. Thus, when the wand is passed through the operator 18, the pad portions 27 are forced outwardly somewhat, and the prongs 26 flex outwardly, in order to create the described resilient frictional bearing of the pads against the wand surfaces.

Referring next to the lower end of the wand 15, there is provided a combination stop and bearing element 31. This is preferably a tube, the upper portion of which is vertically slotted, as shown at 32 in FIGS. 1 and 2, so as to provide prongs 33 that may flex outwardly in order to permit mounting of the stop and bearing element 31 on the lower end of the wand. Preferably, the tube and prongs are formed integrally, of a synthetic resin.

At their upper ends, prongs 33 have inwardly-extending portions 34 that extend into a circular groove 36 at the bottom of the wand. The portion of the wand below groove 36 is frustoconical and downwardly tapered, and the upper-inner ends of the prong portions 34 are chamfered. Accordingly, the stop and bearing element is quickly assembled with the wand by merely pusing upwardly so that the chamfer surfaces 37 engage concial surface 38 to create camming actions that spread the prongs 33. The inwardly-extending portions 34 move upwardly until they are adjacent groove 36, whereupon they snap into the groove to form a bearing relationship between the element 31 and the wand.

In the performing method of the embodiment of FIGS. 1–4, the wand 15, having the operator 18 and stop and bearing element 31 pre-assembled therewith, is quickly mounted on the remaining portion of the venetian blind 10, either as a replacement item or as original equipment. The mounting may be effected quickly relative to the loop or wire portion 17, FIG. 1, for example in the manner described at column 7 of U.S. Pat. No. 3,425,479, starting at line 45.

To effect tilting of the slats 13 in either direction, a person manually grasps the operator 18 and—without permitting such operator to rotate substantially—move it upwardly and downwardly. The driving connection between driver portion 21 and the exterior surfaces of the wand then effects rotation of the wand about its longitudinal axis, to tilt the slats 13 in the desired direction.

After tilting has occurred, the person who has tilted the slats merely releases the operator 18, whereupon it remains in its position due to the friction drag operation of the means 23. There is, therefore, a relatively loose, but driving relationship between driver portion 21 and the wand but, because of the presence of the drag and friction means 23, release of the operator 18 will not permit it to drop, but instead remain in any desired position.

The means 31 at the bottom of the wand prevents the driver 18 from being pulled downwardly completely off the wand, unless complete removal is intended. Complete removal may be effected by shifting prongs 33 outwardly until the inwardly-extending portions 34 thereof are clear of the groove 36.

Especially when the operating mechanism within upper (box) portion 11 of the venetian blind is not perfectly lubricated, the person desiring to tilt the slats 13 may elect to use his or her other hand to grasp the element 31. Element 31 is thus held in a predetermined position in space, and rotation of the wand 15, due to operation of operator 18 by the other hand, is not accompanied by any undesired movement of the wand.

Referring next to FIGS. 5–7, there is illustrated a second embodiment of the operator. This embodiment is more economical than the operator 18.

The second embodiment of the operator comprises a body formed by two opposed "cup" portions 41 and 42 that join at the center. The joint between the cup portions is at a slightly telescoped lip region and is preferably effected by means of suitable adhesive. Preferably, but not necessarily, the cup portions 41–42 are molded of synthetic resin.

Cup portion 41 is the driver, having, preferably but not necessarily at one end, a necked-down region 41a that mates with the wand as described relative to the driver portion 21 of the previous embodiment. The other cup portion, number 42, has integrally formed therein two axially-extending frictional drag portions 43 and 44. Other numbers of drag portions may be used, as previously described.

In the as-molded shape, the frictional drag portions bend inwardly so that their end regions are closer together than are any two opposed surface regions of the wand. Thus, when the synthetic resin body 40 is mounted on the wand 15, the end regions of the frictional drag portions 43 and 44 frictionally and resiliently engage opposed wand surfaces and provide the dragging and braking action that holds the actuator at any desired elevation.

The embodiment of FIGS. 5–7 may also have incorporated therein the above-described stop and bearing element 31.

Figure 9:
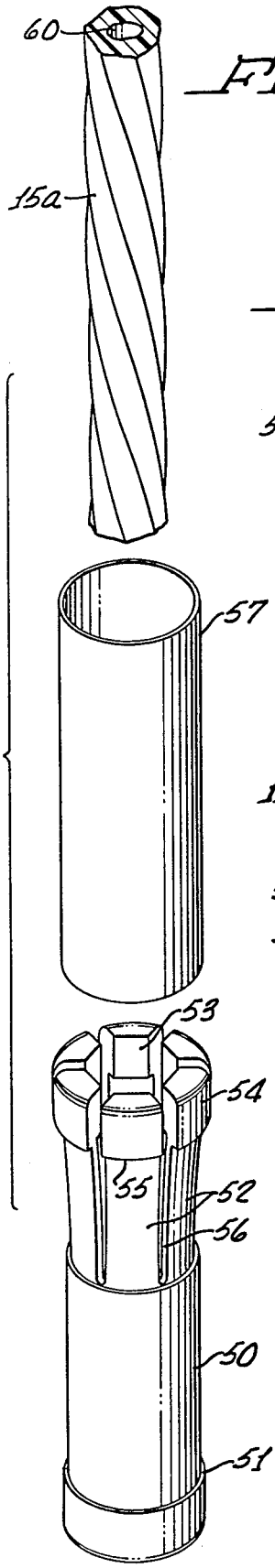
FIG. 9 is an exploded view of a third embodiment of the inventions showing an operator having spring prongs that not only create the drag force, but also prevent rotation between the operator and wand in the absence of relative axial movement.
Figure 11:
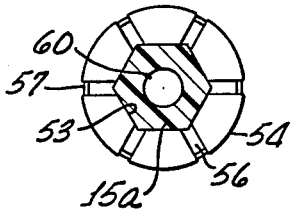
FIG. 11 is a transverse sectional view on line 11—11 on FIG. 10.
Figure 10:
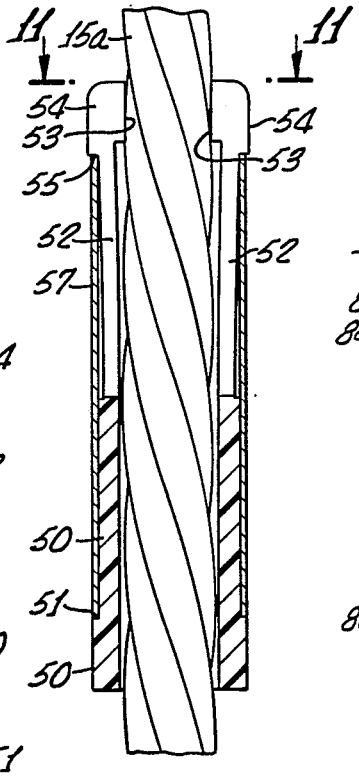
FIG. 10 shows the elements of FIG. 9 assembled and mounted on a wand, the view being primarily a longitudinal section through grooves between adjacent prongs.

Referring next to FIGS. 9–11, there is shown a third embodiment of the operator. Such operator has a synthetic resin body that is integral with prong springs. Pads at the distal ends of the prongs bear against the helical surfaces of wand **15*a*** to create frictional drag forces and also to prevent relative rotational movement between the operator and wand in the absence of relative longitudinal movement therebetween. In other words, the pads not only frictioally engage the helical wand surfaces but also prevent undesired snapping or overriding of ridges between the wand surfaces when a turning force is applied.

Stated more definitely, the operator of FIGS. 9–11 has a synthetic resin body 50, the internal cylindrical surface of which fits around the wand in nonbinding relation relative thereto. The lower end of body 50 is relatively thick, while the portion thereabove is caused to be substantially less thick since the outer cylindrical surface is indented inwardly at shoulder 51. Extending integrally upwardly from the upper end of body 50 are a plurality of prongs or prong-springs 52. Preferably, there are six such prong-springs on the illustrated wand **15*a* which is six-sided as shown in FIG. 11. At the upper end of each prong-spring 52 is a pad 53 that engages one of the sides of wand 15*a*. Each pad 53 is disposed inwardly of an outwardly-extending portion or protrubrance 54, the lower end of which has a shoulder 55. The various shoulders are in line with each other to form an annular shoulder that is continuous except at the slots 56 (FIG. 9) between the adjacent prongs 52**.

A hollow cylindrical sleeve 57, FIG. 9, is sized to fit closely around the prong portions below shoulders 55, and around the body portion above shoulder 51, as shown in FIG. 10. The sleeve 57 may be plastic, decorative metal, etc.

To assemble the sleeve with the integral synthetic-resin element, it is merely necessary to squeeze the various prongs inwardly and then insert the synthetic-resin element upwardly into the bottom of sleeve 57, continuing the upward movement until the prongs snap outwardly as soon as the shoulders 55 are past the upper end of the sleeve. Alternatively, the assembly may be effected by merely pressing the upper ends of the prong-springs into one end of the sleeve 57, because the upper ends of the prongs are externally rounded and thus serve as cams to cam the prong-springs inwardly so that they may pass through the sleeve.

After such assembly, the entire operator is mounted on wand 15a by pushing it over the bottom end of such wand (there being no element at the wand bottom in many embodiments). The wand surfaces then force the pads 53 somewhat outwardly, creating a lever action at the region where shoulders 55 engage the upper end of sleeve 57. When the pads 53 are shifted outwardly somewhat, the prong-spring regions between the pads and the body 50 flex somewhat inwardly, there being a fulcrum region at the upper end of sleeve 57.

Thus, the pads 53 are resiliently engaged with the helical surfaces of wand **15*a*, to create the desired friction drag. Furthermore, the cooperation between the prong-springs and the sleeve 57 maintains the pads 53 sufficiently closely engaged with the helical surfaces to effect rotation of wand 15*a*** when the operator is moved upwardly or downwardly.

If desired, the positiveness of the engagement between pads 53 and the wand surfaces are so adjusted as to permit clutching of the pads from one helical wand surface to the adjacent helical surface after the wand has been rotated to the extreme end of its stroke (as determined by the mechanism shown at the upper portion of FIG. 1). Such clutching tends to prevent breakage of the connection between the wand and the mechanism shown at the upper portion of FIG. 1.

Referring next to FIG. 11, the wand **15*a* is shown as having a passage 60 extending the full length thereof. Such passage is formed when the wand is extruded. The passage 60** is believed to increase the rigidity of the wand as well as conserving material. It is to be understood that the passage through the central part of the wand may be present in any of the wands described or claimed in this application.

Figure 12:
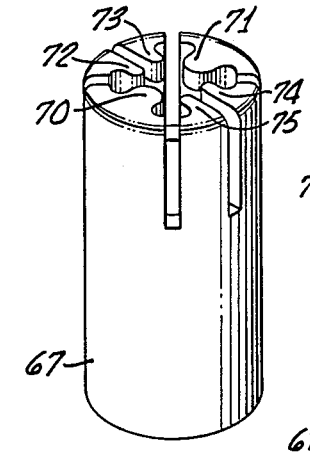
FIG. 12 is an isometric view of a fourth embodiment of the invention.
Figure 13:
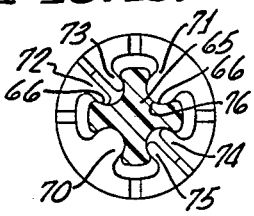
FIG. 13 is a transverse sectional view corresponding to FIG. 11 but showing the embodiment of FIG. 12, the cross-sectional shape of the wand being shown as substantially different from that of FIG. 11.
Figure 14:
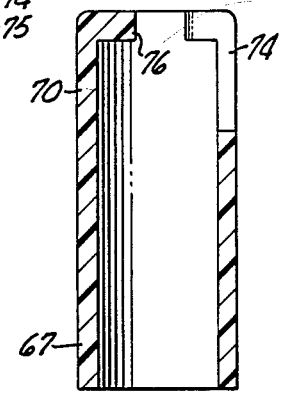
FIG. 14 is a longitudinal view corresponding to FIG. 10 but showing the embodiment of FIGS. 12 and 13.

Referring next to FIGS. 12–14, there is shown a fourth embodiment of the operator. Furthermore, the wand has a different cross-sectional shape than does the wand specifically described above. The embodiment of FIGS. 12–14 is the preferred form.

The wand is numbered 65 and, preferably, has a cross-sectional shape somewhat like that of a four-leaf clover but with a much larger and stronger central portion. Thus, there are four grooves 66, it being understood that there could be a different number of grooves, just as the number of faces of the above-described wand 15a could be somewhat different. The grooves 66 are helical in shape, each curving with the same lead, for example, a lead corresponding to the one shown in FIGS. 9 and 10.

The operator has a cylindrical synthetic-resin body 67 that extends non-bindingly around the wand 65. Formed integrally at the upper (or lower) end of body 67 are prong-springs, the distal ends of the springs bearing against wand 65 in the grooves 66 to provide both frictional drag forces and forces which prevent relative rotation between the operator and wand in the absence of longitudinal movement.

In the as-molded condition, the inner portions (pads) 76 at the ends of diametrically-opposite prong springs are closer together than are the wand surfaces that are engaged thereby when the operator is assembled with the wand. Thus, the assembly forces the prong springs outwardly somewhat to thereby create the desired frictional drag forces.

To describe more particularly the embodiment of FIGS. 12–14, some (or one) of the prong springs are sized to fit one to a groove 66, while others (or another) of the prong springs are sized to fit two to a groove 66. In the illustrated form, the two larger (one to a groove) prong springs are numbered 70 and 71 and are diametrically opposite each other. The remaining prong springs are numbered 72–75, with prong springs 72–73 being adapted to fit into one groove 66, while prong springs 74–75 are adapted to fit into the groove 66 diametrically opposite thereto.

The large prongs 70,71 cooperate with the side walls of the grooves 66 to insure against rotation of the operator relative to the wand, in addition to their function of creating drag forces. The smaller prongs 72,73 and 74,75 cooperate with the walls of their associated grooves 66 to provide the drag forces while creating less resistance (than prongs 70,71) to turning of the operator relative to the wand in the absence of relative longitudinal shifting.

It is to be understood that there could be two prong springs in each of the grooves 66, there then being no large prong springs 70,71. This would reduce the positiveness of the relative rotation-preventing engagement, and could permit clutching (if desired) relative to groove walls of desired inclination. Such clutching, as stated above, would insure against damage to the wand after it rotates as far as it can and despite excessive pressure created by the operator.

The two prong springs (pads thereof) in the grooves 66 are beneficial in that both side walls of the grooves are engaged by pads, there being no slop or play. Stated in another manner, the two prongs per groove (namely, 72,73 and 74,75) provide cooperative drag-creating and rotation-resisting forces, such forces operating both radially and generally tangentially of the wand.

In the illustrated embodiment, FIGS. 12–14, the edge portions of the prong springs extend generally circumterentially of and radially-outwardly from the "arms" of the wand 65, thus enclosing substantially all of the wand except at slots that are present between the prong springs.

The operator of FIGS. 12–14 is assembled with the wand 65 by merely pushing it thereon, the pads 76 then engaging the groove walls and causing the prong springs to flex somewhat outwardly as described above. The operator will then remain at any portion along the length of the wand 65 to provide the desired function of rotating the wand in either direction, in accordance with the direction of longitudinal movement of the operator.

Figure 15:
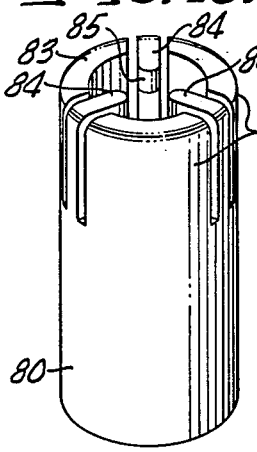
FIG. 15 is an isometric view showing a fifth embodiment of the invention.
Figure 16:
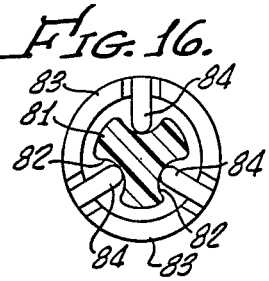
FIG. 16 is a transverse sectional view corresponding to FIG. 10 but showing the embodiment of FIG. 15.
Figure 17:
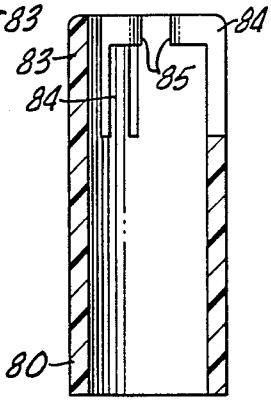
FIG. 17 is a longitudinal view corresponding to FIG. 10 but showing the embodiment of FIGS. 15 and 16.

Referring next to FIGS. 15–17, there is shown a fourth embodiment of the invention. The illustrated operator has a cyclindrical body 80 that extends non-bindingly around the illustrated wand 81. Such illustrated wand 81 is cylindrical but has three helical grooves 82 that are shown as being somewhat concave in cross-section. As before, the helical grooves have the same leads.

Body 80 has upwardly-extending portions 83 that substantially enclose wand 82 without normally engaging it. There are circumferencial gaps between portions 83, and in each of these, there is a prong-spring 84 having a pad 85 that resiliently engages the wall of a groove 82. In there as-molded conditions, the prong springs 84 extend somewhat inwardly, so they are flexed ourwardly when the operator is assembled with the wand 81 to thereby provide the desired drag.

The strengths of the prong springs 84, and the angles of the walls of grooves 82, are so selected that there will be the desired forces preventing rotation of the operator relative to the wand in the absense of relative axial movement. However, and again as stated above, it is possible to cause the forces and angles to be such that there may be clutching of the prongs from one groove to the next in the event that a strong person pushes too hard on the operator after the wand has rotated to the extreme end of its permitted movement.

The foregoing detailed description is to be clearly understood as given by way of illutration and example only, the spirit and scope of this invention being limited solely by the appended claims.

What is claimed is:

1. A venetian blind and venetian blind operating combination, comprising:

(a) a venetian blind, (b) an elongated wand connected, in free-hanging relationship, to a rotatable portion of the venetian blind in such manner that rotation of the wand about its longitudinal axis effects operation of the blind to tilt the slats thereof, said wand having helically-extending surface means, (c) an operator body, and (d) means on said operator body to effect both driving and resilient friction-drag engagement with said surface means, said means (d) being such that said driving and resilient friction-drag engagement is effected at generally the same portion of said surface means, said means (d) comprising at least one prong connected to said operator body and resiliently engaged with said surface means, said prong being integral with said body and being a prong-spring that flexes when engaged with said surface means, said flexing creating the resilient friction-drag engagement.

2. A venetian blind and venetian blind operating combination, comprising:

(a) a venetian blind, (b) an elongated wand connected, in free-hanging relationship, to a rotatable portion of the venetian blind in such manner that rotation of the wand about its longitudinal axis effects operation of the blind to tilt the slats thereof, said wand having helically-extending surface means.

(c) an operator body extending around said wand, and (d) means on said operator body to effect both driving and resilient friction-drag engagement with said surface means, said means (d) being such that said driving and resilient friction-drag engagement is effected at generally the same portion of said surface means, said means (d) comprising at least one prong-spring that extends generally parallel to said wand and is flexed when in engagement with said surface means, said flexing providing said resilient friction-drag engagement.

3. A venetian glind and venetian blind operating combination, comprising:

(a) a venetian blind, (b) an elongated wand connected, in free-hanging relationship, to a rotatable portion of the venetian blind in such manner that rotation of the wand about its longitudinal axis effects operation of the blind to tilt the slats thereof, said wand having helically-extending surface means, (c) an operator body extending longitudinally of said wand and emcompassing the same, and (d) means on said operator body to effect both driving and resilient friction-drag engagement with said surface means, said means (d) being such that said driving and resilient friction-drag engagement is effected at generally the same portion of said surface means, said means (d) comprising a plurality of prong-springs extending from at least one end of said body and being generally parallel to said wand, each of said prong-springs engaging said surface means at a location spaced from said body.

4. A venetian blind and venetian blind operating combination, comprising:

(a) a venetian blind, (b) an elongated wand connected, in free-hanging relationship, to a rotatable portion of the venetian blind in such manner that rotation of the wand about its longitudinal axis effects operation of the blind to tilt the slats thereof, said wand having corresponding helical grooves therein and having helically-extending surface means in said grooves, (c) an operator body extending around said wand, and (d) means on said operator body to effect both driving and resilient friction-drag engagement with said surface means, said means (d) being such that said driving and resilient friction-drag engagement is effected at generally the same portion of said surface means, said means (d) comprising prong-springs that extend generally longitudinally of said wand and resiliently engage the bottom walls of said grooves.

portions of said body extending adjacent said prong-springs and encompassing wand portions between said prong-springs.

5. An operating wand assembly combined with a venetian blind, which comprises:

(a) a venetian blind, (b) an operating wand connected in free-hanging relationship to a rotatable portion of said venetian blind in such manner that rotation of said wand about its longitudinal axis effects operation of the blind to tilt the slats thereof, said wand being an extrusion formed of synthetic resin, said wand having helical drive surface means formed thereon for at least a major portion of the length thereof, (c) an elongate operator mounted around said wand coaxially thereof, said operator being formed of synthetic resin, said operator having a body the inner surface of which is spaced a substantial distance radially-outwardly from the exterior of said wand, and (d) means on said operator to drivingly and resiliently associate said operator with said wand, in such manner that shifting of said operator longitudinally of said wand, without permitting rotation of said operator about its axis, will effect rotation of said wand about its axis, and also in such manner that said operator is at all times resiliently associated with said wand to provide a drag force preventing said operator from moving relative to said wand due to gravity, after said operator is released, said means (d) comprising elongate resilient drag elements that extend generally longitudinally of said wand, that are disposed radially-inwardly of said body between said inner body surface and said wand, and that have a portions in resilient engagement with said wand to provide said drag force.

6. An operating wand assembly combined with a venetian blind, which comprises:

(a) a venetian blind, (b) an operating wand connected in free-hanging relationship to a rotatable portion of said venetian blind in such manner that rotation of said wand about its longitudinal axis effects operation of the blind to tilt the slats thereof, said wand being formed of synthetic resin, said wand having helical drive surface means formed thereon for at least a major portion of the length thereof, and (c) an elongate operator mounted around said wand coaxially thereof, said operator having a sleeve portion mounted on said wand coaxially thereof, the inner surface of said sleeve portion being disposed a substantial distance radially-outwardly from said wand, said operator having elongate resilient prong springs that extend generally axially of said wand, at least major portions of said prong springs being located radially-outwardly of said wand and radially-inwardly of said inner surface of said sleeve portion, said prong springs having ends that are in resilient frictional engagement with said wand, at least some of said prong-spring ends being drivingly engaged with said wand at said helical drive surface means thereof whereby movement of said operator longitudinally of said wand and in the absence of rotation of said operator will effect rotation of said wand about its longitudinal axis.

7. The invention as claimed in claim 6, in which the relationship between said driving prong springs and said wand is such that the ends of such prong springs will clutch after said wand has reached the end of its movement permitted by said venetian blind (a), whereby to prevent breakage of the connecton between said wand and venetian blind.

8. The invention as claimed in claim 6, in which stop means are provided at the bottom end of said wand to prevent said operator from moving down off of said wand.

9. The invention as claimed in claim 8, in which said stop means are a combination stop and bearing element rotatably mounted at said bottom end of said wand.

10. The invention as claimed in claim 8, in which said operator has such a length longitudinally of said wand that substantially all portions of said operator are, at all times, above the bottom end of said wand.

11. A venetian blind and venetin blind operating combination, comprising:

(a) a venetian blind having slats and an operating means contained within a box, (b) an elongated wand connected, in free-hanging relationship, to a rotatable portion of said operating means in such manner that rotation of the wand about its longitudinal axis effects operation of the blind to tilt the slats thereof, said wand having helically-extending surface means, (c) an operator body, and (d) means on said operator body to effect both driving and resilient friction-drag engagement with said surface means, said means (d) being such that said driving and resilient friction-drag engagement is effected at generally the same portion of said surface means.

12. The invention as claimed in claim 11, in which stop means are provided at the bottom end of said wand to prevent said operator body from moving down off of said wand.

13. The invention as claimed in claim 11, in which said stop means are a combination stop and bearing element rotatably mounted at said bottom end of said wand.

14. The invention as claimed in claim 11, in which said operator body has such a length longitudinally of said wand that substantially all portions of said operator body are, at all times, above the bottom end of said wand.

* * * * *

UNITED STATES PATENT AND TRADEMARK OFFICE

CERTIFICATE OF CORRECTION

PATENT NO. : 4,759,398

DATED : July 26, 1988

INVENTOR(S) : William C. Renée

It is certified that error appears in the above-identified patent and that said Letters Patent is hereby corrected as shown below:

Line 7 of the Abstract, please delete "undesided" and substitute therefor ---undesired---.

Column 1, line 25, please delete "preforming" and substitute therefor ---performing---.

Column 1, line 62, please delete "resilent" and substitute therefor ---resilient---.

Column 4, line 41, please delete "the" before the word "performing", and insert ---the--- after the word "performing".

Column 8, line 29, please delete "illutration" and substitute therefor ---illustration---.

Claim 3 (column 9, line 12), please delete "glind" and substitute therefor ---blind---.

Claim 11 (column 11, line 14), please delete "venetin" and substitute therefor ---venetian---.

Signed and Sealed this

Fourteenth Day of February, 1989

*Attest:*

DONALD J. QUIGG

*Attesting Officer*

*Commissioner of Patents and Trademarks*